US007295792B2

(12) United States Patent
Ito

(10) Patent No.: US 7,295,792 B2
(45) Date of Patent: Nov. 13, 2007

(54) IMAGE-FORMING APPARATUS WITH SUPPORT MEMBER HOUSING COMMUNICATIONS UNIT

(75) Inventor: Sakae Ito, Nishikasugai-gun (JP)

(73) Assignee: Brother Koygo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 11/253,624

(22) Filed: Oct. 20, 2005

(65) Prior Publication Data

US 2006/0083542 A1 Apr. 20, 2006

(30) Foreign Application Priority Data

Oct. 20, 2004 (JP) ..... 2004-305142

(51) Int. Cl.
*G03G 15/00* (2006.01)

(52) U.S. Cl. ..... 399/107; 399/367

(58) Field of Classification Search ..... 399/107, 399/110, 367
See application file for complete search history.

(56) References Cited

U.S. PATENT DOCUMENTS 4,718,085 A * 1/1988 Haskins ..... 379/438
5,790,922 A * 8/1998 Takano ..... 399/107
5,844,687 A * 12/1998 Nagane et al. ..... 399/107
6,125,249 A * 9/2000 Ootsuka et al. ..... 358/296
2004/0062583 A1* 4/2004 Kameyama et al. ..... 399/405
2004/0228650 A1* 11/2004 Saito ..... 399/107
2004/0247337 A1 12/2004 Ohama et al.
2006/0056875 A1* 3/2006 Karasawa et al. ..... 399/107
2007/0071492 A1* 3/2007 Ito ..... 399/107

FOREIGN PATENT DOCUMENTS

JP 10020596 1/1998

* cited by examiner

*Primary Examiner*—David M. Gray
*Assistant Examiner*—Ruth N. LaBombard
(74) *Attorney, Agent, or Firm*—Banner & Witcoff, Ltd

(57) ABSTRACT

A multifunction device includes a scanning unit, an image-forming unit, and a joint holder for supporting the scanning unit on top of the image-forming unit. The joint holder is configured of a rear holder disposed on the upper rear side of the image-forming unit and two side holders disposed on top of the image-forming unit on the left and right sides for supporting the scanning unit on three sides. A network control unit is accommodated in an internal space in the rear holder, while a backup battery and a speaker are accommodated in internal spaces in the side holders. Accordingly, the multifunction device is downsized.

9 Claims, 7 Drawing Sheets

IMAGE-FORMING APPARATUS WITH SUPPORT MEMBER HOUSING COMMUNICATIONS UNIT

BACKGROUND OF THE INVENTION

1. Technical Field

The present invention relates to an image-forming device equipped with an image-reading unit for reading image data from an original document.

2. Related Art

Proposals have been made for image-forming devices having a basic function and the capability of adding expanded functions as needed. One such image-forming device is disclosed in Japanese patent application publication No. HEI-10-20596. FIG. 7 shows an example of the image-forming device disclosed in this publication. As shown in FIG. 7, the image-forming device includes an engine section 211, and a stacked paper-delivery section 212 disposed on top of the engine section 211. When adding a printer function and facsimile function, a scanner unit 213 is disposed on top of the stacked paper-delivery section 212; and an expansion board accommodating unit 241 is provided between the engine section 211 and the scanner unit 213 in parallel with the stacked paper-delivery section 212. The expansion board accommodating unit 241 accommodates an expansion board related to the printer function and/or facsimile function. A basic board accommodating unit 240 is disposed adjacent to the engine section 211 and below the expansion board accommodating unit 241.

With this construction, the space between the basic board accommodating unit 240 and the portion of the scanner unit 213 that extends over the stacked paper-delivery section 212 can be effectively used for accommodating the expansion board accommodating unit 241. Since the expansion board accommodating unit 241 accommodates an expansion board related to expanded functions, the footprint of the entire device can be kept small when adding expanded functions.

However, recent image-forming devices are continually being made smaller, with particular emphasis on a compact body. The conventional arrangement described above, in which the expansion board accommodating unit 241 is provided adjacent to the stacked paper-delivery section 212 and between the engine section 211 and scanner unit 213 for accommodating expansion boards, provides the expansion board accommodating unit 241 external to the main body of the image-forming device so that the expansion boards are not provided inside the image-forming device. Such an arrangement is insufficient for producing a compact image-forming device.

SUMMARY

In view of the foregoing, it is an object of the present invention to provide an image-forming device having equipped with an image-reading unit for reading image data from an original document and configured so as to be sufficiently compact.

The present invention provides an image-forming apparatus having: an image-forming unit, an image-reading unit, a support member, and an image-communication unit. The image-forming unit forms an image on a recording medium. The image-forming unit has an upper portion and a rear portion. The image-reading unit reads an image from an original document. The support member is provided on the upper portion of the image-forming unit to support the image-reading unit above the image-forming unit. The image-communication unit communicates an image with a network. At least a part of the image-communication unit is accommodated in the support member.

BRIEF DESCRIPTION OF THE DRAWINGS

The above and other objects, features, and advantages of the invention will become more apparent from reading the following description of the embodiments taken in connection with the accompanying drawings in which.

DESCRIPTION OF THE EMBODIMENTS

An image-forming device according to the present invention will be described while referring to FIGS. 1 through 6.

Figure 1:
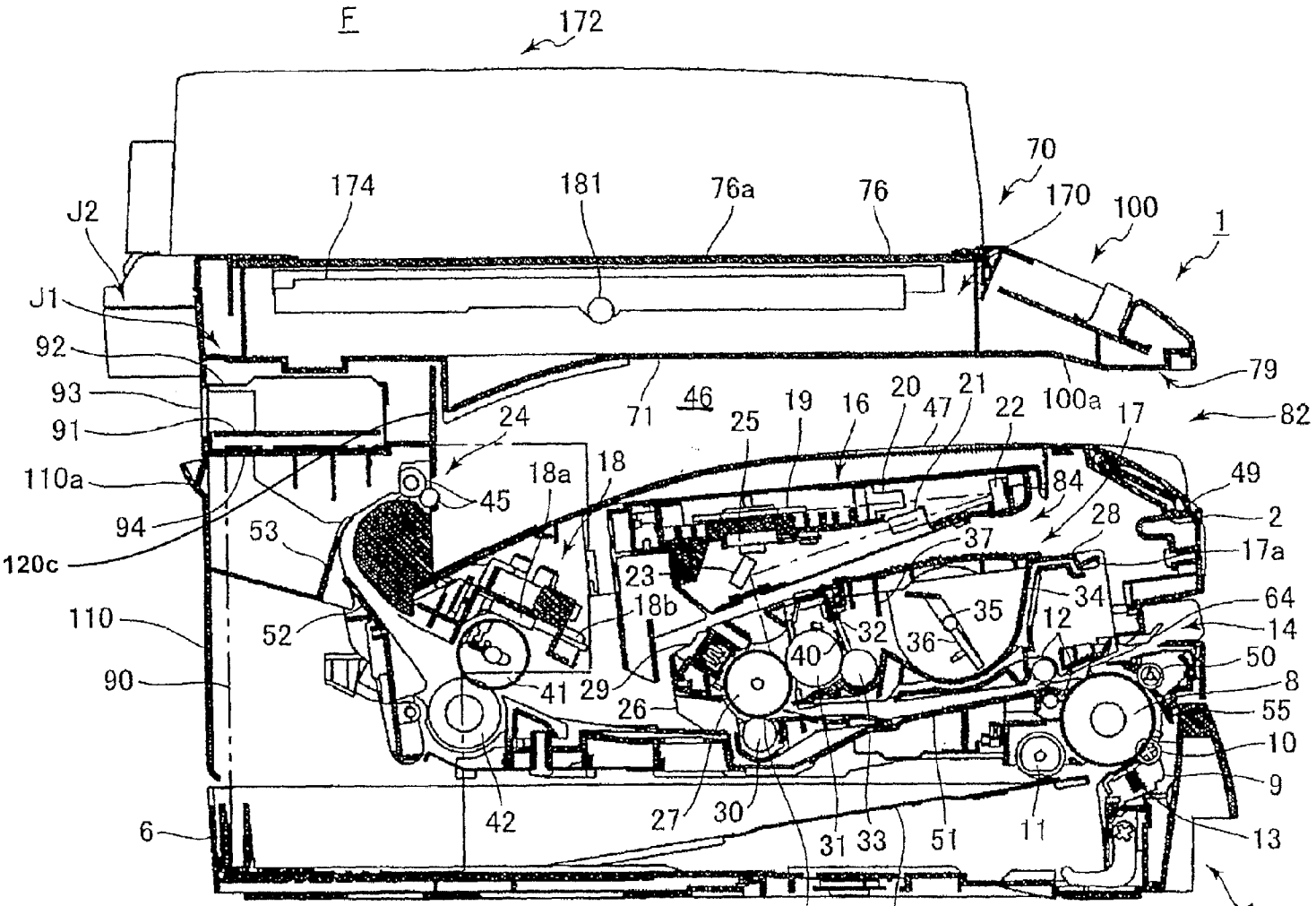
FIG. 1 is a side cross-sectional view showing a multifunction device F according to the present invention.

Referring to FIG. 1, a multifunction device F includes an image-forming unit 1 for forming prescribed images on a paper 3; and a flatbed scanning unit 70 that is mounted on the image-forming unit 1. The multifunction device F is provided with a printer function to form an image on the paper 3, a scanning function to read an image from an original document, a copier function to make a copy of an image, and facsimile function to transmit and receive an image through a network.

Overall Structure

First, the general structure of the multifunction device F will be described with reference to FIG. 1. In FIG. 1, the multifunction device F is viewed along the axial direction of various rollers described later. In the following description, the right side of FIG. 1 is referred to as a forward direction of the device F, while the left side of FIG. 1 is referred to as a backward direction of the device F. A side surface of the image-forming unit 1 on the left side in FIG. 1 is considered the "rear surface," side surfaces of the image-forming unit 1 on the near and far sides in the drawing are considered "side surfaces," a top surface of the image-forming unit 1 with respect to the vertical is considered a "top part," and a side surface of the image-forming unit 1 on the right side in FIG. 1 is considered a "front surface."

Figure 2:
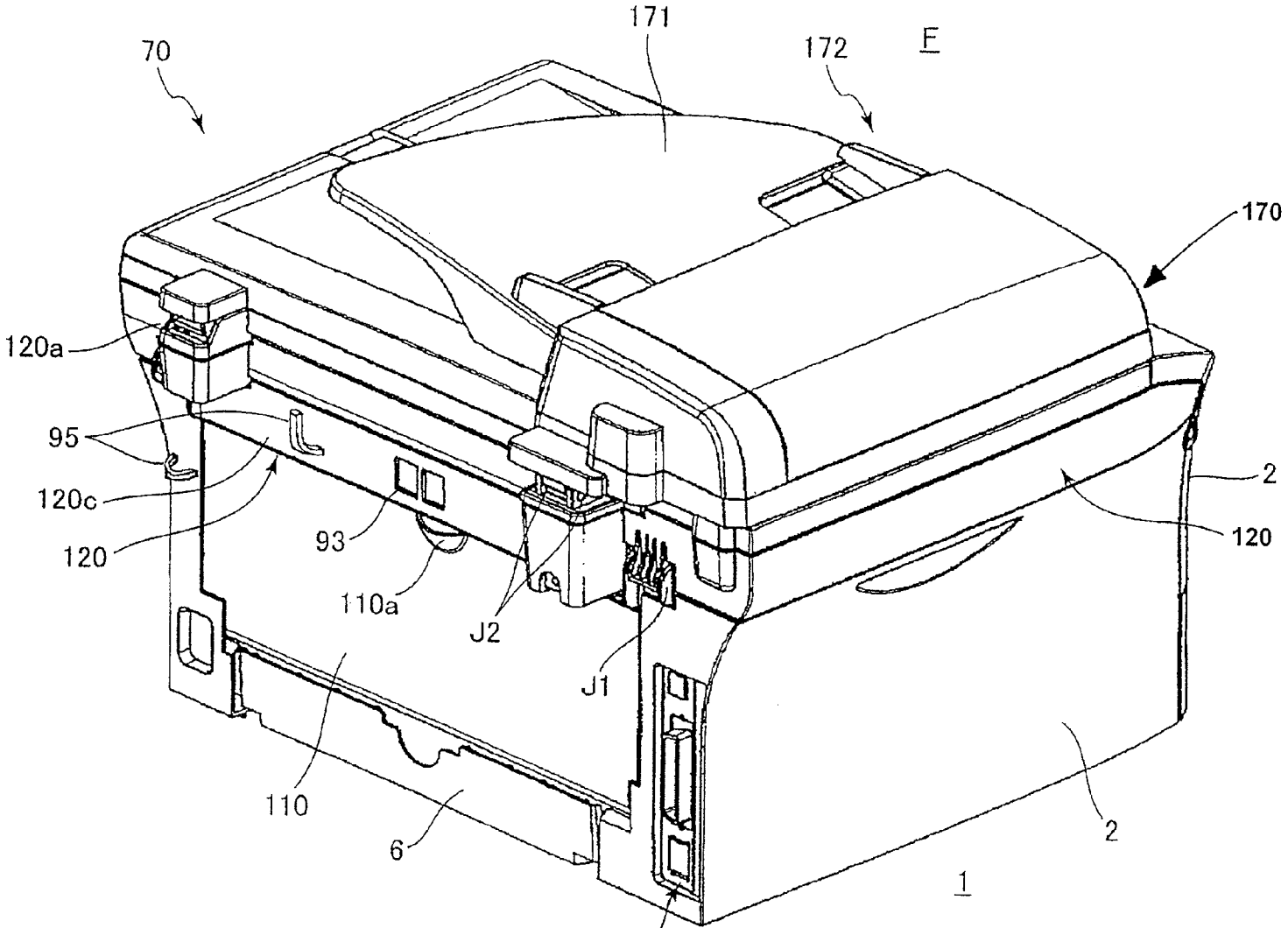
FIG. 2 is a perspective view of the multifunction device F in FIG. 1.
Figure 3:
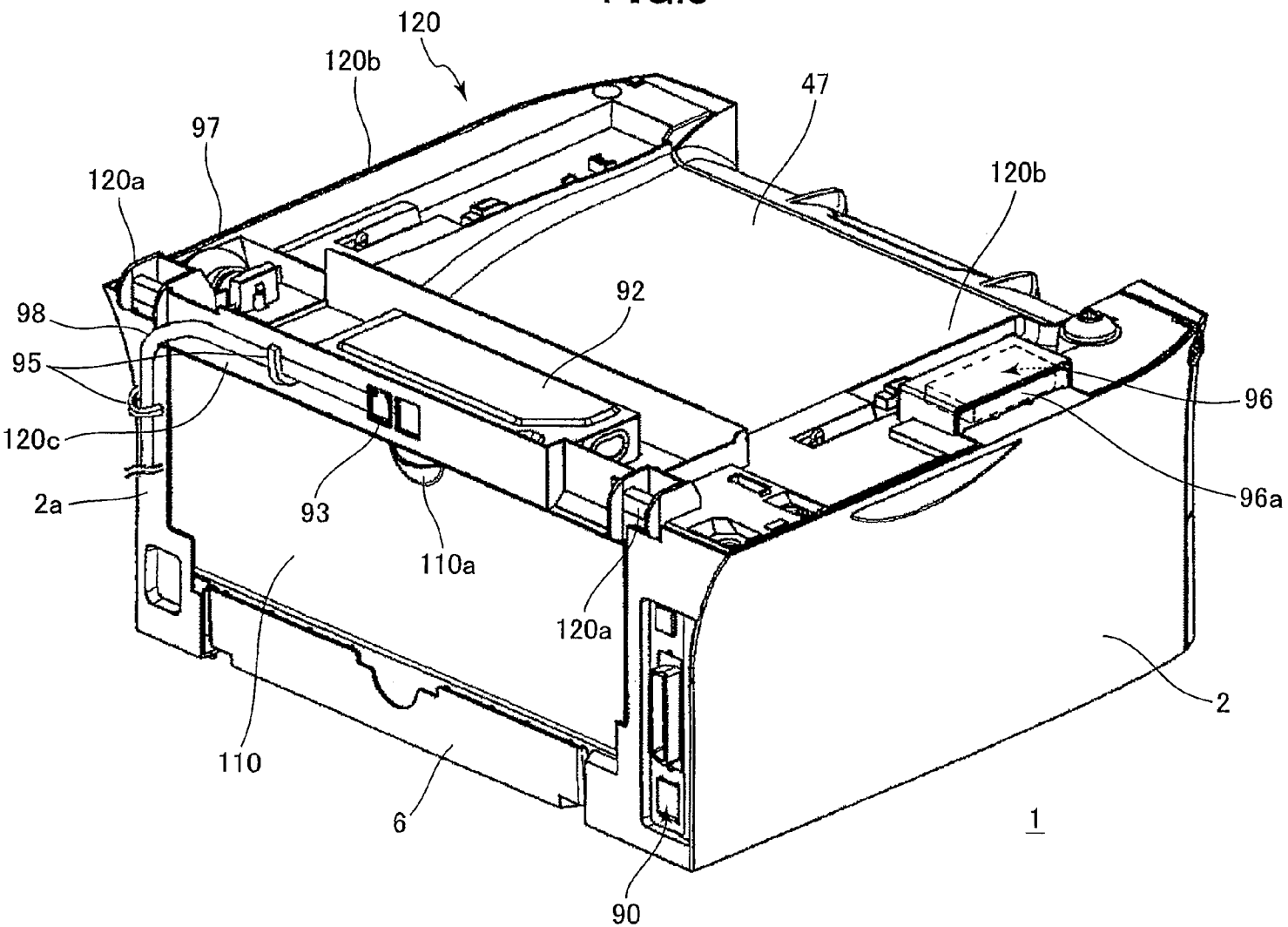
FIG. 3 is a perspective view showing an image-forming unit of the multifunction device of FIG. 1.

The image-forming unit 1 in FIG. 1 consists of a laser printer. The image-forming unit 1 includes a main casing 2 formed of a synthetic resin, the external appearance of which is shown in FIGS. 2 and 3. Disposed within the main casing 2 are a feeder unit 4, a scanner unit 16, a process unit 17, and a fixing unit 18.

Structure of the Feeder Unit

As shown in FIG. 1, the feeder unit 4 is disposed in a lower section of the main casing 2 and functions to supply sheets of the paper 3 for a printing process. The feeder unit 4 includes a paper cassette 6, a paper pressing plate 7 provided inside the paper cassette 6, a pickup roller 11 positioned above one end of the paper cassette 6, a feeding roller 8 and separating pad 9 disposed downstream of the pickup roller 11 in a paper-conveying direction, a pinch roller 10 disposed in opposition to the feeding roller 8, a paper dust roller 50 also disposed in opposition to the feeding roller 8 downstream of the pinch roller 10 in the paper-conveying direction, and a pair of registration rollers 12 disposed downstream of the paper dust roller 50 in the paper-conveying direction. A guide part 55 is also provided near the periphery of the feeding roller 8 for forming a part of the paper-conveying path designed to reverse the conveying direction of the paper 3 from a forward direction to a rearward direction as the paper 3 is conveyed around the feeding roller 8.

The pickup roller 11, feeding roller 8, pinch roller 10, and guide part 55 feed a sheet of the paper 3 from the paper cassette 6 in a forward direction, guide the paper 3 to reverse directions and continue toward the rear side of the image-forming unit 1, so that the paper 3 is conveyed to the process unit 17 disposed above the paper cassette 6. Below, each of these components will be described in more detail.

The paper pressing plate 7 is pivotably supported on the end farthest from the feeding roller 8, enabling the end nearest the feeding roller 8 to move vertically. A spring (not shown) is disposed on the underside of the paper pressing plate 7, urging the paper pressing plate 7 upward. As the number of sheets of paper 3 stacked on the paper pressing plate 7 increases, the front end of the paper pressing plate 7 opposes the urging force of the spring and pivots downward about a pivot point on the end farthest from the feeding roller 8.

Through the work of the paper pressing plate 7, the pickup roller 11 is configured to contact the topmost sheet of paper 3 stacked in the paper cassette 6. The pickup roller 11 rotates to feed the sheet of paper 3 to a position from which the feeding roller 8 can convey the sheet, that is, a position between the feeding roller 8 and separating pad 9.

The separating pad 9 is disposed at a position opposing the feeding roller 8. A spring 13 is disposed on the underside of the separating pad 9 to press the separating pad 9 against the feeding roller 8. The separating pad 9 functions to prevent a plurality of sheets of the paper 3 from being supplied along the paper-conveying path in an overlapped state.

Hence, the pickup roller 11 conveys the sheet of paper 3 until the sheet contacts the feeding roller 8 and separating pad 9. At this time, the separating pad 9 applies an appropriate frictional force to the paper 3 and stops all sheets of the paper 3 except the topmost sheet when the pickup roller 11 conveys a plurality of sheets to the separating pad 9. Accordingly, the feeding roller 8 can supply the paper 3 one sheet at a time.

As the feeding roller 8 conveys the sheet of paper 3 along the conveying path to the registration rollers 12, the paper dust roller 50 removes paper dust from the sheet. The paper-conveying path formed from the top of the feeding roller 8 to an image-forming position P1 described later slopes downward slightly from the horizontal. This section of the paper-conveying path is primarily formed by a guide member 51, and the bottom surface of the process unit 17.

When conveying the paper 3 to the registration rollers 12, the feeding roller 8 changes the conveying direction by about 180°. If the curvature of the feeding roller 8 were too large at this time, a thick paper 3 such as a postcard could become bent around the feeding roller 8 or may not be conveyed to the registration rollers 12 due to the resistance generated by the bending of the paper 3.

For this reason, the feeding roller 8 has a larger diameter than other rollers used in the image-forming unit 1, such as a photosensitive drum 27 and a heating roller 41 described later. For example, the diameter of the feeding roller 8 is set to 33 mm, while the diameters of the photosensitive drum 27 and heating roller 41 are set to 24 mm and 25 mm, respectively. By setting the diameter of the feeding roller 8 relatively large to reduce the curvature at which the paper 3 is curved, the feeding roller 8 can convey the paper 3 reliably without bending the same.

The driving operation of the registration rollers 12 is started and stopped to correct the registration of the paper 3. More specifically, a position sensor 64 is disposed near the feeding roller 8; and a main circuit board 90 is disposed inside the image-forming unit 1 along the rear surface and near the side surface of the same. The main circuit board 90 includes a control device for controlling the operations of the registration rollers 12 based on a detection timing by the position sensor 64. The control device drives the registration rollers 12 while the feeding roller 8 is conveying the sheet of paper 3, and halts the registration rollers 12 when the position sensor 64 detects the leading edge of the paper 3. After the paper 3 contacts the registration rollers 12 and the registration rollers 12 register the paper 3, the control device again drives the registration rollers 12 to convey the paper 3 into the image-forming unit 1.

The position sensor 64 consists of a mechanical device that is displaced from a prescribed position when contacted and pushed by the leading edge of the paper 3.

A manual feed opening 14 is formed in the front side of the image-forming unit 1 slightly above the feeding roller 8 for directly feeding the paper 3 to the position of the registration rollers 12 through the front of the image-forming unit 1 so that the paper 3 can be supplied onto the conveying path without being loaded in the paper cassette 6.

Structure of the Scanning Unit

The scanner unit 16 is disposed in an upper section of the image-forming unit 1 and includes a laser light-emitting unit (not shown), a polygon mirror 19 that is rotatably disposed, a polygon motor 25 for driving the polygon mirror 19 to rotate, lenses 20 and 21, and reflecting mirrors 22 and 23. The laser light-emitting unit emits a laser beam that passes through or is reflected by the polygon mirror 19, lens 20, reflecting mirror 22, lens 21, and reflecting mirror 23 in the order given along a path indicated by a line of alternating dots and dashes in FIG. 1. The laser beam is irradiated in a high-speed scan over the surface of the photosensitive drum 27 in the process unit 17.

More specifically, the polygon mirror 19 is disposed in the scanner unit 16 directly above the image-forming position P1 described later and the photosensitive drum 27. The polygon mirror 19 reflects a laser beam in a substantially horizontal direction toward the reflecting mirror 22. The reflecting mirror 22 reflects the laser beam to the reflecting mirror 23, which is positioned just beneath the polygon mirror 19. That is, the reflecting mirror 22 reflects the incident laser beam downward at an angle of about 15° to the horizontal. The scanner unit 16 configured of the polygon mirror 19, lenses 20 and 21, and reflecting mirrors 22 and 23 has a size and shape that does not block the optical path of the laser beam. Specifically, the top surface of the scanner unit 16 is nearly level but slopes slightly downward away from the front of the image-forming unit 1. The bottom surface of the scanner unit 16 slopes downward away from the front of the image-forming unit 1 at a greater slope than the top surface. With this configuration, the scanner unit 16 is shaped thicker on the side near the image-forming position P1 at which the polygon mirror 19 is positioned, and tapers toward the front surface of the image-forming unit 1.

Structure of the Process Unit

Figure 4:
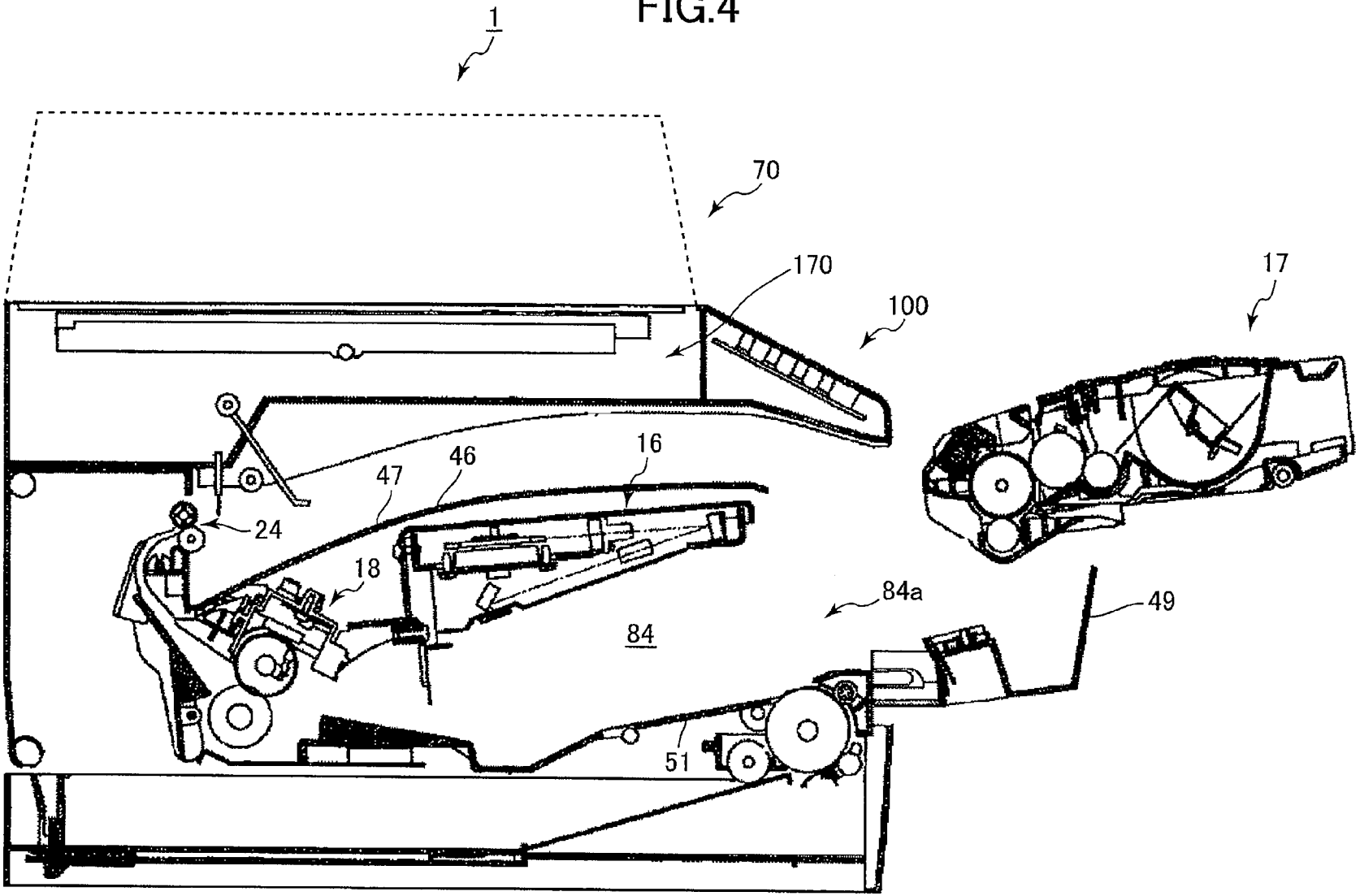
FIG. 4 is an explanatory diagram showing the multifunction device F of FIG. 1 when an image-reading unit has been removed.

As shown in FIGS. 1 and 4, the process unit 17 is detachably mounted in the image-forming unit 1 through the front surface thereof. The process unit 17 includes at least the photosensitive drum 27. Referring to FIG. 4, an accommodating section 84 for accommodating the process unit 17 is formed in the image-forming unit 1 below the scanner unit 16 and above the paper-conveying path. As shown in FIG. 4, an opening 84*a* in fluid communication with the accommodating section 84 is formed in the front surface of the image-forming unit 1. The process unit 17 can be loaded into the accommodating section 84 or removed from the accommodating section 84 via the opening 84*a*.

The process unit 17 is mounted in the main casing 2 below the scanner unit 16 in a substantially horizontal direction through the front surface of the main casing 2 and is detached in the opposite direction. The process unit 17 includes a drum cartridge 26 and a developer cartridge 28. A space is formed between the process unit 17 and the scanner unit 16.

The drum cartridge 26 of the process unit 17 includes the photosensitive drum 27, a Scorotron charger 29, and a transfer roller 30. The developer cartridge 28 of the process unit 17 includes a developer roller 31, a thickness-regulating blade 32, a toner supply roller 33, and a toner box 34. The developer cartridge 28 is detachably mounted on the drum cartridge 26.

The components constituting the process unit 17 that occupy most of space are the photosensitive drum 27 and the toner box 34. Therefore, the photosensitive drum 27 and toner box 34 are not disposed directly above the feeding roller 8 and the registration rollers 12, which also occupy a relatively large space.

The toner box 34 is filled with a toner. A rotational shaft 35 is disposed in the center of the toner box 34. An agitator 36 is provided on the rotational shaft 35 and is capable of rotating clockwise in FIG. 1. A toner supply opening 37 is formed in the rear side of the toner box 34. The rotating agitator 36 stirs the toner in the toner box 34, discharging some of the toner through the toner supply opening 37.

The toner supply roller 33 is disposed at a position on the rear side of the toner supply opening 37 and is capable of rotating counterclockwise in FIG. 1. The developer roller 31 is disposed in confrontation with the toner supply roller 33 and is capable of rotating in the counterclockwise direction. The developer roller 31 and toner supply roller 33 contact each other with pressure so that each is compressed to some degree.

The toner supply roller 33 is configured of a metal roller shaft covered by a roller that is formed of an electrically conductive foam material. The developer roller 31 is configured of a metal roller shaft covered by a roller that is formed of an electrically conductive rubber material having no magnetic properties. More specifically, the roller portion of the developer roller 31 has a surface made from an electrically conductive urethane rubber or silicon rubber including fine carbon particles, which is coverer with a coating layer made from a urethane rubber or silicon rubber including fluorine. During a developing operation, a developing bias is applied to the developer roller 31.

The thickness-regulating blade 32 is disposed near the developer roller 31. The thickness-regulating blade 32 is configured of a main blade member formed of a metal leaf spring member, and a pressing part 40 provided on the distal end of the main blade member. The pressing part 40 has a semicircular cross-section and is formed of an insulating silicon rubber. The thickness-regulating blade 32 is supported on the developer cartridge 28 near the developer roller 31 so that the elastic force of the main blade member urges the pressing part 40 to contact the developer roller 31 with pressure.

Toner discharged through the toner supply opening 37 by the rotation of the agitator 36 is supplied onto the developer roller 31 by the rotation of the toner supply roller 33. At this time, the toner is positively tribocharged between the toner supply roller 33 and developer roller 31. As the developer roller 31 continues to rotate, the toner supplied onto the surface of the developer roller 31 passes between the pressing part 40 of the thickness-regulating blade 32 and the developer roller 31, at which time the toner is further tribocharged and is smoothed so that a thin layer of uniform thickness is carried on the developer roller 31.

The photosensitive drum 27 is disposed at a position along the rear side of the developer roller 31 and is capable of rotating clockwise in FIG. 1 while in confrontation with the developer roller 31. The photosensitive drum 27 includes a main drum body that is grounded, and a surface layer formed of a positive charging photosensitive material such as polycarbonate. A main motor (not shown) generates a motive force for driving the photosensitive drum 27 to rotate.

The charger 29 is disposed in opposition to the photosensitive drum 27, but separated a prescribed distance therefrom and is positioned about 30° above the horizontal along a radial direction of the photosensitive drum 27. The charger 29 consists of a positive charging Scorotron charger having a charging wire formed of tungsten from which a corona discharge is generated. The charger 29 functions to charge the entire surface of the photosensitive drum 27 with a uniform positive polarity.

As the photosensitive drum 27 rotates, the charger 29 charges the surface of the photosensitive drum 27 with a uniform positive polarity. Subsequently, the scanner unit 16 irradiates a laser beam in a high-speed scan to form an electrostatic latent image on the surface of the photosensitive drum 27 based on prescribed image data.

Next, positively charged toner carried on the surface of the developer roller 31 comes into contact with the photosensitive drum 27 as the developer roller 31 rotates and is supplied to areas on the surface of the positively charged photosensitive drum 27 that were exposed to the laser beam and, therefore, have a lower potential. In this way, the latent image on the photosensitive drum 27 is developed into a visible image according to a reverse development process.

The transfer roller 30 is rotatably supported in the drum cartridge 26 at a position below the photosensitive drum 27. The transfer roller 30 is capable of rotating in the counterclockwise direction of FIG. 1 while confronting the photosensitive drum 27. The transfer roller 30 is configured of a metal roller shaft covered by a rubber material with ionic conductivity. A forward transfer bias is applied to the transfer roller 30 during a transfer operation. As a consequence, the visible image carried on the surface of the photosensitive drum 27 is transferred onto a sheet of the paper 3 passing the image-forming position P1 between the photosensitive drum 27 and the transfer roller 30.

Structure of the Fixing Unit

The fixing unit 18 is disposed downstream of the process unit 17 in the paper-conveying direction. The fixing unit 18 includes the heating roller 41, a pressure roller 42 that contacts the heating roller 41 with pressure, and a thermostat 18*a*. A cover 18*b* functions to cover the heating roller 41 and the thermostat 18*a*.

The heating roller 41 is formed of a metal and accommodates a heater configured of a halogen lamp.

A Spring (not shown) is provided on the pressure roller 42 for rotatably pressing the pressure roller 42 from below toward the rotational axis of the heating roller 41. The pressure roller 42 follows the rotation of the heating roller 41 in close contact with the heating roller 41 or the paper 3.

The thermostat 18*a* is a bi-metal thermostat that functions to turn the power of the heater for heating the heating roller 41 on and off in response to the temperature of the heating roller 41. The thermostat 18*a* prevents the heating roller 41 from being heated to an abnormally high temperature.

The cover 18*b* is shaped to cover the top and sides of the heating roller 41 to prevent heat generated by the heating roller 41 from escaping outside of the fixing unit 18 and adversely affecting other components in the image-forming unit 1. The cover 18*b* rotatably supports the pressure roller 42 about a central shaft thereof so that the pressure roller 42 is capable of moving in the urging direction of the spring. The lower half of the pressure roller 42 is exposed from the cover 18*b*. Therefore, the height of the image-forming unit 1 can be reduced by the difference in the thickness of the cover 18*b* from the thickness of a cover that could cover even the bottom of the pressure roller 42.

In the fixing unit 18 having this construction, toner transferred onto a sheet of paper 3 in the process unit 17 is fixed by heat generated in the heating roller 41 and pressure provided by the pressure roller 42, as the paper 3 passes between the heating roller 41 and pressure roller 42. After the fixing process, the paper 3 is conveyed along a discharge path leading to the top surface of the main casing 2. The discharge path is formed by guide members 52 and 53 and leads from the fixing unit 18 to the top surface of the main casing 2 while reversing the conveying direction from a rearward direction to a forward direction. A discharge opening 24 is formed at the top of the discharge path and is in fluid communication with the same. A pair of discharge rollers 45 is disposed at the top of the discharge path in the discharge opening 24. A discharge tray 46 is formed on the top of the main casing 2. When a sheet of the paper 3 is conveyed along the discharge path from the fixing unit 18, the discharge rollers 45 receive the sheet and discharge the sheet through the discharge opening 24 onto the discharge tray 46.

As shown in FIGS. 1 and 2, a rear cover 110 is rotatably provided on the rear surface of the image-forming unit 1. The rear cover 110 has a grip part 110*a* formed in the center of the upper edge of the rear cover 110. If a paper jam occurs in the fixing unit 18, the user can access the fixing unit 18 through the rear surface of the image-forming unit 1 to remove the jammed paper by gripping the grip part 110*a* and rotating the rear cover 110 downward.

If the paper 3 is made to curve abruptly after being heated by the heating roller 41, the paper 3 may remain curled and may not return to its uncurled state. For this reason, the guide member 52 and guide member 53 that the paper 3 contacts after passing the heating roller 41 curve gently immediately after the heating roller 41 and curve abruptly upon nearing the discharge rollers 45.

With this construction, the discharge opening 24 can be positioned lower than when the entire discharge path is made to curve gently, thereby making it possible to reduce the height of the multifunction device F while preventing permanent curvature of the paper 3.

The discharge tray 46 is formed of a top surface 47 of the image-forming unit 1, a bottom surface 71 of the scanning unit 70, and a rear holder 120*c* (see FIG. 2) described later. The paper 3 discharged through the discharge opening 24 can be stacked on the top surface 47 of the image-forming unit 1. Hence, the space defined by the top surface 47 of the image-forming unit 1, the bottom surface 71 of the scanning unit 70, and the rear holder 120*c* is formed large sufficient to accommodate a prescribed number of stacked sheets of the paper 3. Accordingly, the rear holder 120*c*is formed with a prescribed height or greater.

In the multifunction device F described above, the main circuit board 90 includes a control device for controlling the driving of various rollers and the polygon mirror 19. As indicated by the line with alternating dashes and double dots in FIG. 1, the main circuit board 90 is disposed near the left side when viewed from the front of the image-forming unit 1 to the rear of the paper-conveying path.

As shown in FIG. 1, a network control unit (NCU) 91 described later is disposed in the top portion on the rear of the image-forming unit 1.

Method of Removing the Process Unit

Next, the user-performed operation to remove the process unit 17 from the image-forming unit 1 will be described with reference to FIGS. 1 and 4.

As shown in FIGS. 1 and 4, the image-forming unit 1 includes a front cover 49 disposed on the front of the main casing 2. The front cover 49 is rotatably attached to the main casing 2 at the bottom edge of the front cover 49 and is capable of swinging forward and downward about a support shaft (not shown) to expose the opening 84*a*. To remove the process unit 17 from the mounted state shown FIG. 1, the user first opens the front cover 49 to the position shown in FIG. 4.

Next, the user pulls the process unit 17 in a substantially horizontal direction from the image-forming unit 1 so that the process unit 17 passes over the feeding roller 8. To facilitate this removal, a depression 17*a* is formed in the front side of the process unit 17. Since a space is formed between the process unit 17 and the scanner unit 16, as described above, the user can lift the process unit 17 by the depression 17*a* toward the scanner unit 16 and then pull the process unit 17 out from the image-forming unit 1. The above construction prevents the rear end of the process unit 17 from being caught by the image-forming unit 1, thereby enabling a user to smoothly pull the process unit 17 out from the image-forming unit 1.

Method of Assembling the Multifunction Device F

Next, a method of attaching the scanning unit 70 to the image-forming unit 1 of the multifunction device F will be described with reference to FIGS. 2 and 3.

As shown in FIGS. 2 and 3, the attachment of the scanning unit 70 to the image-forming unit 1 employs a joint holder 120 located on top of the image-forming unit 1.

The joint holder 120 is formed from a polystyrene resin that does not contain a reinforcing material such as glass fibers. The joint holder 120 for supporting the scanning unit 70 includes scanning unit mounting parts 120*a*, side holders 120*b* disposed on the left and right sides on the top of the image-forming unit 1, and the rear holder 120*c* disposed on the top rear of the image-forming unit 1. The scanning unit mounting parts 120*a*, side holders 120*b*, and rear holder 120*c* form three sides of a rectangle when viewed from above the image-forming unit 1. Since the scanning unit 70 is supported on three sides consisting of the side holders 120*b* and rear holder 120*c*, the joint holder 120 can hold the scanning unit 70 with sufficient stability.

In the multifunction device F, a predetermined space is provided between the image-forming unit 1 and the scanning unit 70 so that the paper 3 can be accommodated in a stacked condition on the discharge tray 46 formed on top of the image-forming unit 1. Accordingly, the joint holder 120 has a prescribed height for providing the predetermined space. Moreover, the joint holder 120 has an internal hollow space inside in order to reduce the total weight and restrict the manufacturing cost of the multifunction device F.

When disposing of the image-forming unit 1, the backup battery 96 can be removed and disposed separately from the image-forming unit 1 as follows. As shown in FIG. 3, the backup battery 96 is accommodated in a battery cover 96*a* formed of synthetic resin having a seam (not shown) running along one surface. The user can open the scanning unit 70 and push down on the surface of the battery cover 96*a* to tear the seam and remove the backup battery 96.

Structure of the NCU

Next, the NCU 91 will be described with reference to FIGS. 1 and 3.

Referring to FIG. 1, the NCU 91 is connected to a public telephone line and functions to perform network control processes to transmit dialing signals on the telephone line, and respond to call signals received from the telephone line. In other words, the NCU 91 is used to transmit and receive voice and facsimile data from the multifunction device F and another communication device such as telephone and facsimile device through a network such as a public phone network.

Since the NCU 91 uses high-speed signals, the NCU 91 is easily affected by electromagnetic waves. Therefore, external electromagnetic waves may cause disorders in the NCU 91. Accordingly, a shield cover 92 for blocking external electromagnetic waves is provided to cover the NCU 91. The NCU 91 and shield cover 92 are accommodated within the rear holder 120*c* of the joint holder 120 in order to make effective use of the internal space inside the joint holder 120. The NCU 91 is used for communicating data with an external device, rather than directly consisting of part of the image-forming unit 1 and the scanning unit 70. The NCU 91 can be accommodated in the internal space of the joint holder 120 for mounting the scanning unit 70 to the image-forming unit 1. Accordingly, the multifunction device F can be made sufficiently compact by effectively using the internal space in the joint holder 120 that supports the scanning unit 70.

In addition, speakers 97 and a backup battery 96 can be accommodated in the internal space inside the joint holder 120. The backup battery 96 is provided to supply power in the event of a power outage in order to prevent data stored in the multifunction device F from disappearing.

With the above construction, it is unnecessary to attach an optional casing on the outside of the image-forming unit 1 for accommodating components such as the NCU 91, speakers 97, and backup battery 96 which relate to expansion functions rather than the printing and scanning functions. As a result, the multifunction device F can be downsized without functional degradation.

As described above, by utilizing the internal space in the joint holder 120 to accommodate the components such as the NCU 91, speakers 97, and backup battery 96, it is possible to produce a more compact multifunction device F.

An opening 94 is formed in the bottom surface of the shield cover 92 and the top surface of the image-forming unit 1 that contacts the bottom surface of the shield cover 92. A harness (not shown) connects the NCU 91 to the main circuit board 90 via the opening 94. Since the main circuit board 90 is positioned directly below the NCU 91 when the NCU 91 is provided inside the rear holder 120*c*, the length of the harness can be extremely short, facilitating processing of the harness.

Referring to FIG. 3, a cable 98 is supplied for connecting the NCU 91 to an external device such as a telephone line. A connector 93 is provided to the rear of the NCU 91 in the rear holder 120*c* for connecting the cable 98 to the NCU 91. Another connector is mounted on top of the NCU 91. This construction facilitates the connection of the NCU 91 to an external device. Further, the cable 98 is not visible from the front of the image-forming unit 1, thereby improving the appearance of the multifunction device F.

If the cable 98 connected to the connector 93 is allowed to simply hang down from the connector 93, the cable 98 would be a great impediment to the user in gripping the grip part 110*a* and opening the rear cover 110 when a paper jam occurs in the fixing unit 18. The cable 98 could also get caught on the rear cover 110 when the user attempts to open the same. To resolve this problem, clamps 95 are attached to positions 2*a* on the rear surface of the image-forming unit 1 at which the rear cover 110 and grip part 110*a* are not provided, as shown in FIG. 3. In this way, the clamps 95 are fixed at the positions 2*a* of the main casing 2 so as not to interfere with the rotating of the rear cover 110. The clamps 95 are capable of fixing up to two cables 98. The connector 93 may also be horizontally offset from the grip part 110*a* to facilitate gripping of the grip part 110*a*. Further, since the connector to the main circuit board 90 is provided on the right side of the rear surface of the image-forming unit 1 for connecting to a computer device (not shown), the clamps 95 may be provided to the rear surface of the image-forming unit 1 on the right side with respect to the connector 93 connected to the cable 98.

By providing the NCU 91 in the rear holder 120*c* farther rearward than the discharge opening 24, the NCU 91 does not impede discharging of the paper 3. Further, since the paper-conveying path from the guide member 53 to the discharge opening 24 extends away from the rear surface of the image-forming unit 1, a large space formed over the top of the image-forming unit 1 to the rear of the discharge opening 24 can be used effectively.

Structure of the Scanning Unit

As shown in FIG. 1, the discharge tray 46 is formed on top of the image-forming unit 1 and is capable of accommodating a stack of the paper 3 discharged from the discharge opening 24. The scanning unit 70 is disposed above the discharge tray 46 so as to cover the same so that the top surface 47 of the image-forming unit 1 opposes a bottom surface 71 of the scanning unit 70.

As shown in FIGS. 1 and 2, the scanning unit 70 includes an automatic document feeder (ADF) 172. The portion of the scanning unit 70 that includes the ADF 172 is configured to rotate open to the rear side of the scanning unit 70 about a rotational axis indicated conceptually by the reference numeral J2. The entire scanning unit 70 is also configured to rotate open to the rear about another rotational axis indicated conceptually by J1. The ADF 172 shown in FIGS. 1 and 5 is a brief sketch.

Figure 5A:
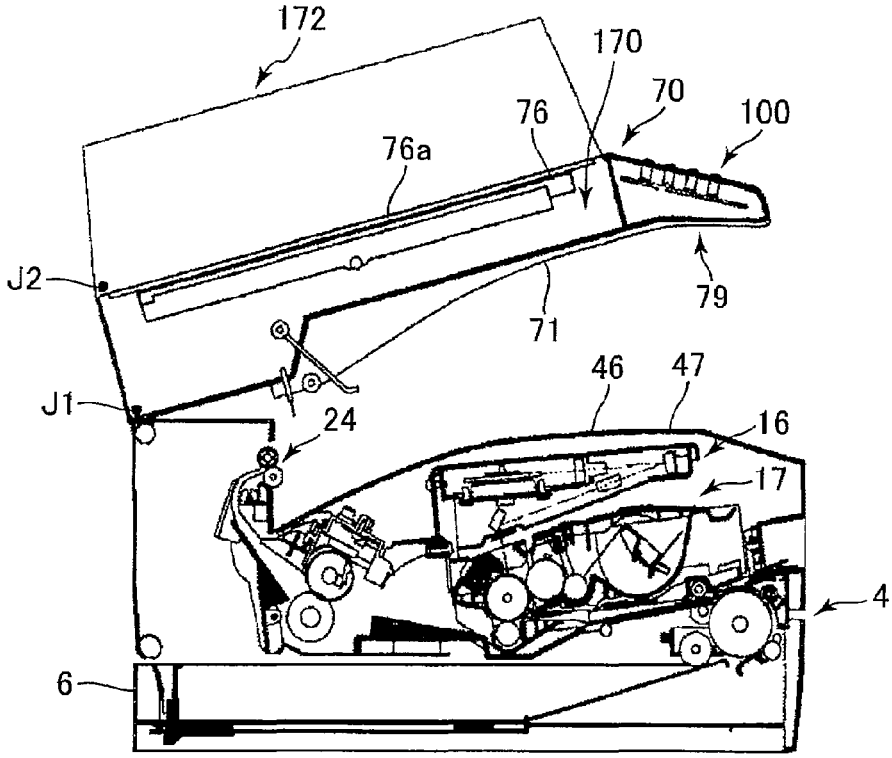
FIG. 5A is a side view showing the multifunction device when the image-reading unit has been rotated open to the rear.
Figure 5B:
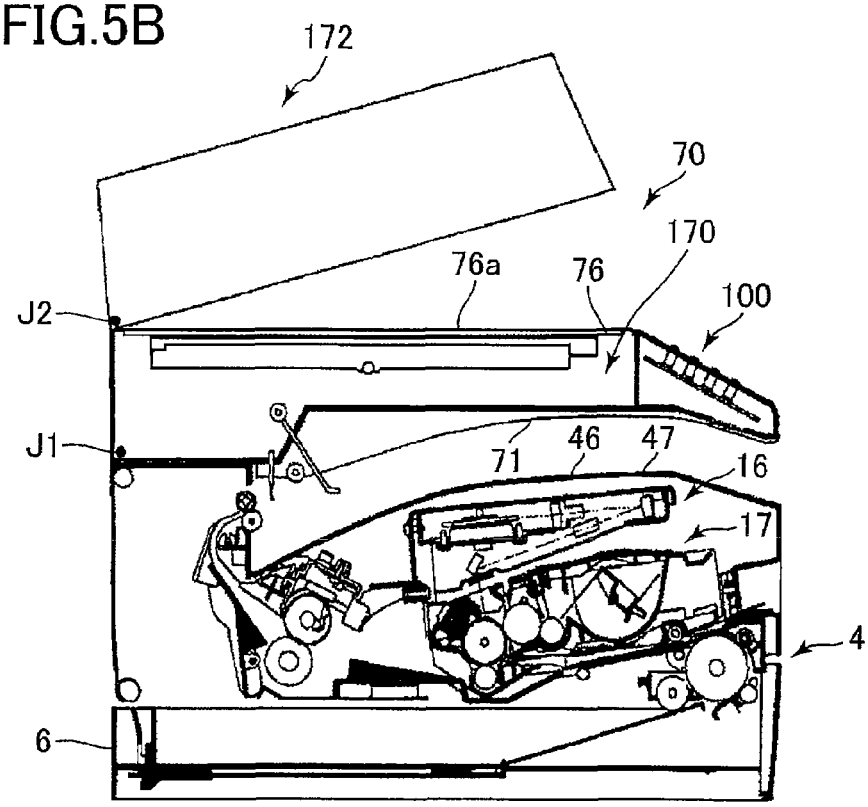
FIG. 5B is a side view showing the multifunction device when an automatic document feeder has been rotated open to the rear.

The scanning unit 70 is a flatbed type of scanner, as shown in FIG. 5B, opening the ADF 172 section of the scanning unit 70 exposes a document scanning unit 76 having a document support surface 76*a*. When a book or other original document is placed on the document support surface 76*a*, the document scanning unit 76 is capable of scanning image data from this document.

Figure 6:
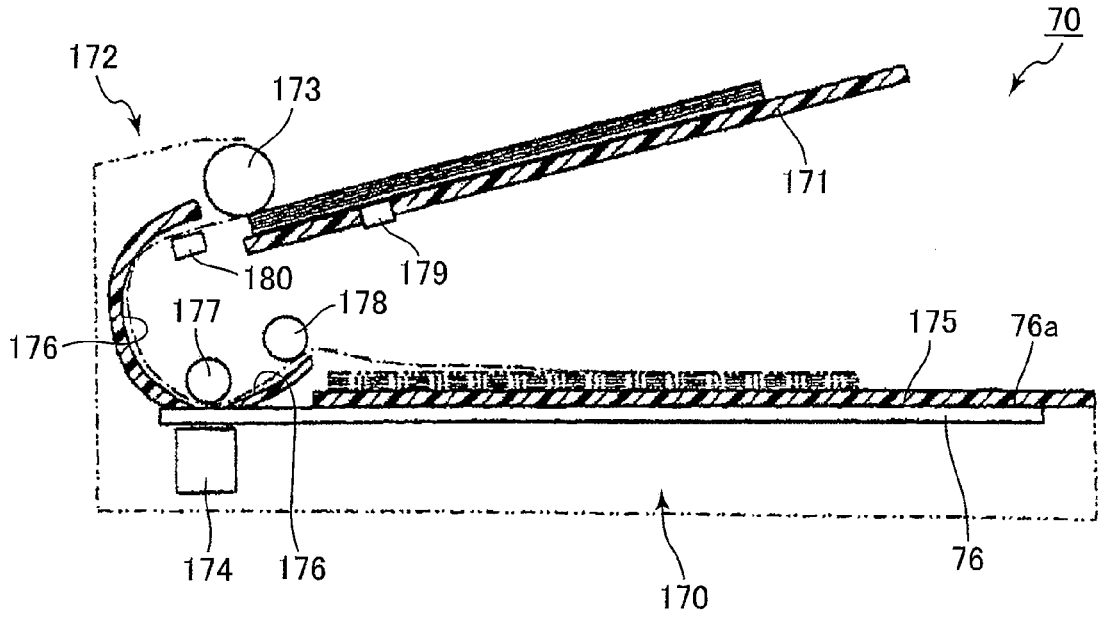
FIG. 6 is a cross-sectional view showing the image-reading unit viewed from the front side of the multifunction device F.
Figure 7:
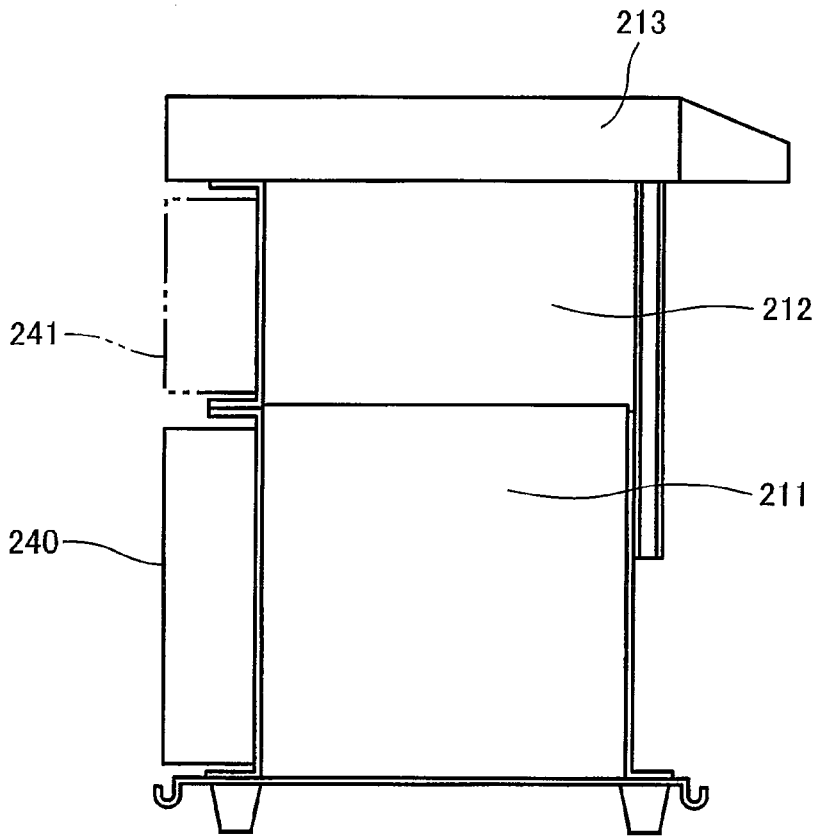
FIG. 7 is a side view of a conventional digital image-forming device.

As shown in FIG. 6, the scanning unit 70 includes a document tray 171 for supporting sheets of an original document in a stacked state; the ADF 172; and a main scanning unit body 170. The main scanning unit body 170 includes the document scanning unit 76 formed of a glass plate; a contact image sensor (CIS) 174 disposed beneath the document scanning unit 76 on the upstream end in a document conveying direction (rear end of the scanning unit 70) for reading images from the surface of the original document as the document is conveyed along the document scanning unit 76; and a discharge tray 175 disposed on the document support surface 76*a* of the document scanning unit 76 for receiving original documents that have been scanned by the CIS 174.

The ADF 172 includes a substantially U-shaped conveying path 176 leading from the downstream end of the document tray 171 to the upstream end of the discharge tray 175; a feeding roller 173 disposed on the upstream end of the conveying path 176 for separating and guiding the original document stacked on the document tray 171 onto the conveying path 176 one sheet at a time; a paper detecting sensor 180 disposed along the conveying path 176 near the feeding roller 173 for detecting passage of the original document; a pressure roller 177 rotatably disposed on the conveying path 176 at a position confronting the CIS 174 across the document scanning unit 76 for pressing the original document guided along the conveying path 176 tightly against the document scanning unit 76; and a discharge roller 178 disposed on the downstream end of the conveying path 176 for discharging the original document onto the discharge tray 175.

The CIS 174 is a line-type sensor that extends in a direction orthogonal to the document conveying direction and includes a plurality of photodiodes (not shown) aligned in the extended direction of the CIS 174. The CIS 174 has a light source (not shown) for projecting an intense light onto the original document. The light reflected off the original document is received by the individual photodiodes, and the light intensity (brightness) of the reflected light for each pixel in the original document is converted into electric signals. The scanning unit 70 includes an A/D converter (not shown) for converting these signals to digital data, enabling an image formed on the original document to be read as image data.

Documents can be scanned in the scanning unit 70 by placing the original document on the document support surface 76*a* of the document scanning unit 76, that is, the glass plate surface, or by using the ADF 172 described above. In the former case, the CIS 174 is moved along a shaft 181 (see FIG. 1) that extends in a direction orthogonal to the surface of the drawing in FIG. 1 and along the document support surface 76*a* of the document scanning unit 76 for scanning the document supported on the document scanning unit 76 one line at a time. In the latter case, the CIS 174 is moved to the left edge of the document scanning unit 76 and fixed at a position opposing the pressure roller 177 via the document scanning unit 76. The CIS 174 scans an original document one line at a time as the document is conveyed by the ADF 172.

As shown in FIG. 5A, the multifunction device F is configured so that the scanning unit 70 can rotate about the rotational axis J1 so that the bottom surface 71 of the scanning unit 70 separates from the top surface 47 of the discharge tray 46. As shown in FIG. 5A, the scanning unit 70 includes an extended part 79 that extends toward the front surface of the main casing 2 over the discharge tray 46. When the scanning unit 70 is rotated upward about the rotational axis J1, a large separation is formed particularly between the discharge tray 46 and the extended part 79.

As shown in FIG. 1, the scanning unit 70 is disposed over the discharge tray 46 in the multifunction device F so as to cover the discharge tray 46. The main reading unit body 170 of the scanning unit 70 functions as a cover for covering the discharge tray 46. A control panel 100 is provided on the front of the main reading unit body 170 and has a bottom surface 100*a* that confronts the top surface 47 of the discharge tray 46. The control panel 100 extends forward from the main reading unit body 170 and includes an operating section with buttons and a display section (not shown) on the top surface thereof.

In the multifunction device F, an opening 82 is formed between the control panel 100 and the discharge tray 46 to facilitate the retrieval of the paper 3 that has been discharged onto the discharge tray 46. Further, since the scanning unit 70 is capable of rotating upward as shown in FIG. 5A, the control panel 100 can be raised to separate the top surface 47 of the discharge tray 46 from the bottom surface 100*a* of the control panel 100.

While the invention has been described in detail with reference to specific embodiments thereof, it would be apparent to those skilled in the art that many modifications and variations may be made therein without departing from the spirit of the invention, the scope of which is defined by the attached claims.

While the purpose of the rear cover 110 described above is for accessing the paper-conveying path near the fixing unit in order to remove paper 3 that has become jammed therein, other purposes for the rear cover 110 may be considered. For example, when using a thick paper 3, the paper 3 can become bent when passing through the conveying path formed by the guide member 52 and guide member 53 since the path curves abruptly near the discharge opening 24. However, by using the space formed by opening the rear cover 110 as a paper discharge opening, the paper 3 can be discharged after image formation without being bent.

Figure 8:
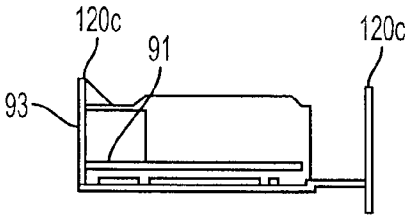
FIG. 8 shows a detailed version of a portion of FIG. 1 in accordance with aspects of the present invention.
Figure 9:
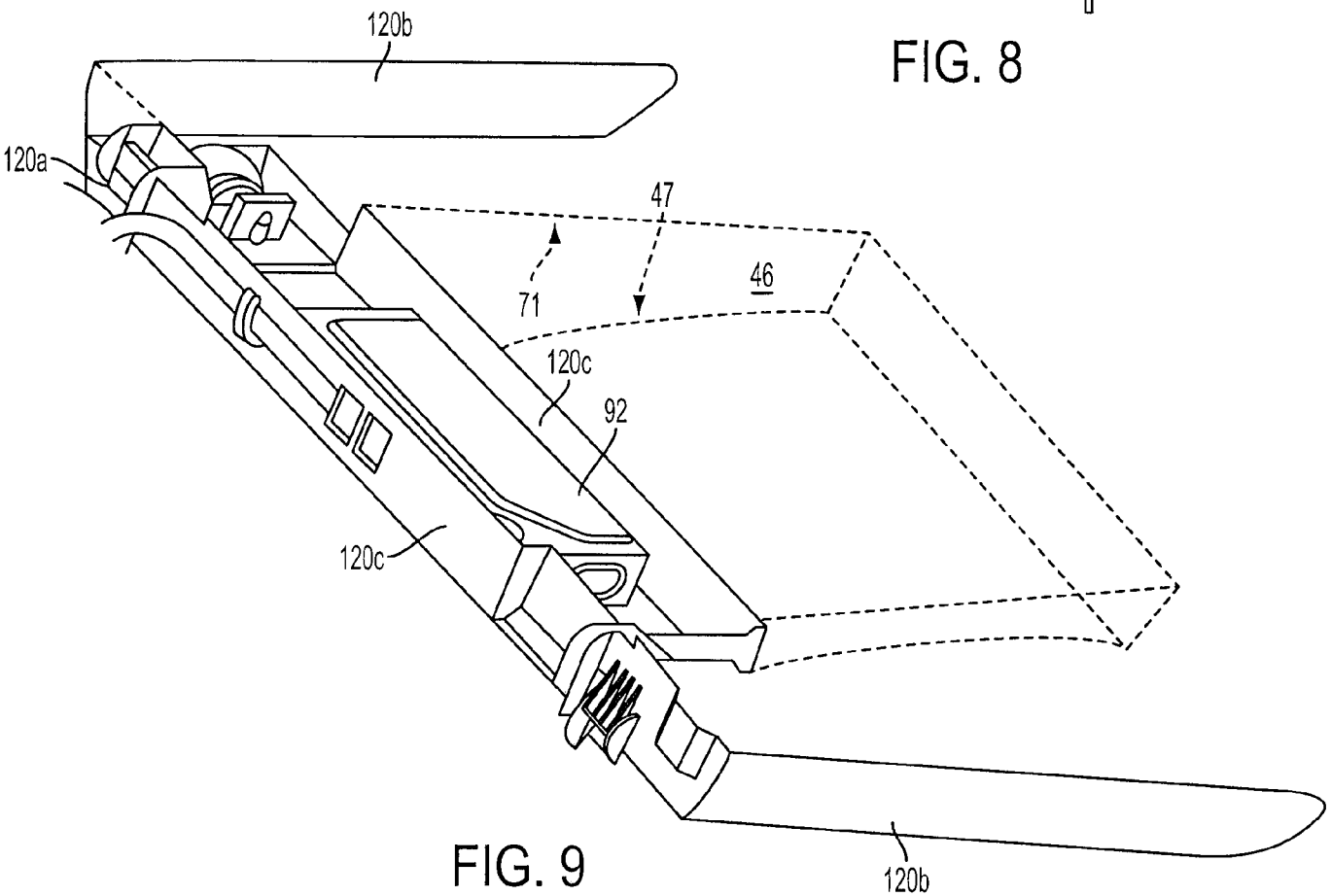
FIG. 9 shows a detailed version of combined portions from FIGS. 2 and 3 in accordance with aspects of the present invention.

FIG. 8 shows a detailed version of a portion of FIG. 1, showing the rear support member 120*c*, NCU 91, and connector 93. FIG. 9 shows a detailed version of combined portions from FIGS. 2 and 3, showing the NCU cover 92, the rear support member 120*c*, and side support members 120*b*. In dotted lines, discharge tray area 46 is shown as bounded by the rear support member 120*c*, the bottom surface 71 of the image scanning unit 70, and the top surface 47 of the image forming unit 1.

In the above embodiment, the scanning unit 70 described above is a flatbed scanner. Alternatively, the scanning unit 70 may be a sheet-feed type of scanner that scans image data from the original fed past the CIS 174 without the document scanning unit 76 for supporting the original document. In this case, the NCU 91 can still be provided in the rear holder 120*c*, which supports the scanning unit 70 on the image-forming unit 1. When using a sheet-feed scanning unit 70, the size and installation space required for the scanning unit 70 itself is reduced.

What is claimed is:

1. An image-forming apparatus comprising:

an image-forming unit configured to form an image on a recording medium, the image-forming unit having an upper surface and a rear surface;

an image-reading unit configured to read an image from an original document;

a support member provided on the upper surface of the image-forming unit to support the image-reading unit above the image-forming unit, the support member including a rear support portion provided on a rear part of the upper surface and a side support portion provided on a side part of the upper surface; and an image-communication unit that communicates the read image with a network, the image-communication unit being accommodated in the support member.

2. The image-forming apparatus according to claim 1, further comprising a connector that connects a communication cable to the image-communication unit, the connector being provided on the rear support portion of the support member, the image-communication unit is accommodated in the rear support portion of the support member.

3. The image-forming apparatus according to claim 2, further comprising:

a rear cover that is capable of rotating open to expose a paper-conveying path;

a grip portion that is capable of rotating the rear cover; and a holding member that holds the communication cable at a position on the rear portion of the support member in order to prevent the communication cable from overlapping the grip portion, the grip portion and the holding member being provided on the rear portion of the support member.

4. The image-forming apparatus according to claim 3, wherein the holding member holds the communication cable at a position on the rear portion of the support member in order to prevent the communication cable from interfering with a rotation of the rear cover.

5. The image-forming apparatus according to claim 1, further comprising a discharge opening provided in the upper surface of the image-forming unit for discharging the recording medium having the image formed thereon, the discharge opening is provided on a front side of the rear support portion of the support member; wherein at least a part of the image-reading unit is accommodated in the rear support portion of the support member.

6. The image-forming apparatus according to claim 5, further comprising a paper stacking portion that is configured to receive the recording medium discharged from the discharge opening, the paper stacking portion being defined by the upper surface of the image-forming unit, a lower portion of the image-reading unit, and the support member.

7. The image-forming apparatus according to claim 1, further comprising:

at least one of a speaker and a backup power supply for the image-reading unit, wherein said at least one of said speaker and said backup power supply is accommodated in the support member.

8. The image-forming apparatus according to claim 1, wherein the image-reading unit comprises a document carrying portion that carries the original document thereon.

9. An image-forming apparatus comprising:

an image-forming unit configured to form an image on a recording medium, the image-forming unit having an upper surface and a rear surface, a portion of the upper surface of the image-forming unit defining a lower boundary of a paper discharge region;

an image-reading unit configured to read an image from an original document, a lower surface of the image-reading unit defining an upper boundary of the paper discharge region;

a support member provided at least on the upper surface of the image-forming unit to support the image-reading unit above the image-forming unit, at least a front surface of the support member defining a rear boundary of the paper discharge region and defining at least some of a volume of the paper discharge region; and an image-communication unit that communicates the read image with a network, at least a part of the image-communication unit being accommodated in the support member.

* * * * *